United States Patent [19]

Martin et al.

[11] 4,102,285

[45] Jul. 25, 1978

[54] KNOCK-DOWN STARTING PLATFORM FOR A ROOF SEAMING MACHINE

[75] Inventors: James W. Martin, Kansas City; John R. Hardwick, Gower, both of Mo.

[73] Assignee: Butler Manufacturing Company, Kansas City, Mo.

[21] Appl. No.: 794,150

[22] Filed: May 5, 1977

[51] Int. Cl.[2] ..... B21D 39/00

[52] U.S. Cl. ..... 113/54 R

[58] Field of Search ..... 113/54, 55, 56, 57, 113/58; 145/1 B; 269/269, 296; 211/182; 248/165, 200

[56] References Cited

U.S. PATENT DOCUMENTS

| | | | |
|---|---|---|---|
| 2,998,832 | 9/1961 | Lewis | 269/296 X |
| 3,669,051 | 6/1972 | Conway et al. | 113/54 |

*Primary Examiner*—Leon Gilden

*Attorney, Agent, or Firm*—Shoemaker and Mattare, Ltd.

[57] ABSTRACT

A knock-down starting platform for a roof seaming machine includes spaced side frame rails joined at one end with a platform on which a roof seaming machine may be supported and joined at their other end with a movable gate or bridge. The bridge carries a member which is adapted to be secured relative to a roof panel to support the rails and platform on a roof with the platform supported beyond the edge of the roof and the rails disposed in straddling relationship to the seam between adjacent panels. The side frame rails and bridge comprise a plurality of releasably connected together parts separable from one another to enable the starting platform to be disassembled for storage, shipment and handling.

7 Claims, 6 Drawing Figures

KNOCK-DOWN STARTING PLATFORM FOR A ROOF SEAMING MACHINE

BACKGROUND OF THE INVENTION

This invention relates generally to starting platforms for supporting a roof seaming machine beyond the edge of a roof to begin rolling or forming a seam between adjacent roof panels.

U.S. Pat. No. 3,669,051, owned by the same assignee as the present invention, discloses a starting platform for a roof seaming machine, whereby the roof seaming machine may be supported beyond the edge of a roof to thereby avoid the necessity of a workman having to stand near the eave of the building in order to support the machine for starting the seam between adjacent roof panels. However, the starting platform disclosed in U.S. Pat. No. 3,669,051 is essentially a one-piece construction and thus requires substantial space for storage, handling and shipping. In fact, the starting platform is generally shipped by truck at the same time that roof paneling and the like is shipped for installation. On some occasions the builder does not order a starting platform and shipment of the platform thus would present possible problems of delay and damage. Moreover, the roof seaming machine is generally shipped by bus to the builder. Additionally, there are times when a starting platform is needed quickly by a builder and some means other than shipment by truck is desirable where necessary.

In accordance with the present invention, a unique starting platform is provided which may be disassembled into a number of components occupying a small amount of space and thus may be readily shipped by bus or the like for emergency use. More specifically, the starting platform of the present invention is an improvement over the starting platform disclosed in U.S. Pat. No. 3,669,051 and may be knocked down for shipment and handling. Further, the starting platform of the present invention is lighter in weight, and in some cases, more sturdy than the prior platform. Accordingly, the problems found with the prior art starting platform are obviated with the present invention.

OBJECTS OF THE INVENTION

Thus, it is an object of the present invention to provide a starting platform for supporting a roof seaming machine beyond the edge of a roof, wherein the starting platform may be disassembled to a number of components occupying a relatively small amount of space, whereby the starting platform may be easily handled and shipped and which requires a relatively small amount of space for storage.

A further object of the invention is to provide a knock-down starting platform for a roof seaming machine which is light in weight and sturdy in construction.

BRIEF DESCRIPTION OF THE DRAWINGS

FIG. is a fragmentary perspective view of a portion of a roof and a starting platform in accordance with the invention, and showing vise grip pliers which may be used to clamp the bridge portion of the starting platform to the seam between adjacent roof panels.

DETAILED DESCRIPTION OF THE INVENTION

Figure 1:
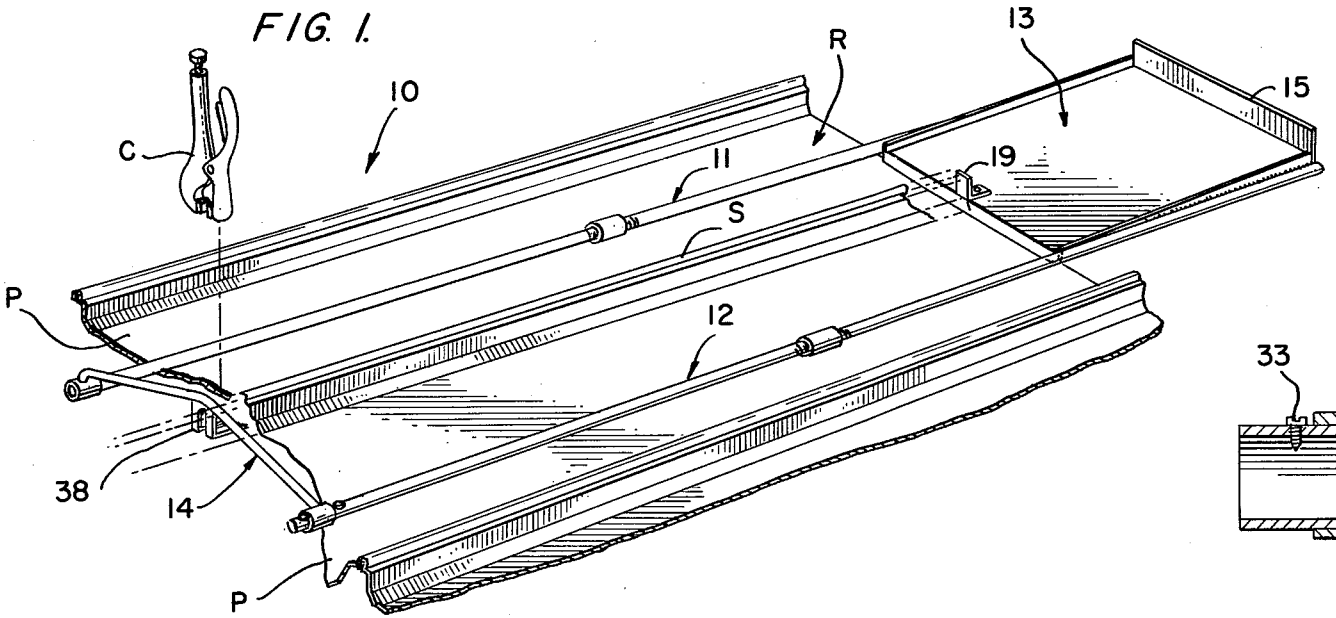

In the drawings, wherein like reference numerals indicate like parts throughout the several views, a starting platform in accordance with the invention is indicated generally at 10 and comprises a pair of side frame rails 11 and 12 having a machine support portion or platform 13 supported at one end thereof and a bridge or gate member 14 at the other end thereof. A suitable clamping device C, such as vise grip pliers or the like, is shown about to be positioned or clamped on the seam S between adjacent panels P of the roof R to hold the bridge 14 downwardly the thus support the roof platform 10 on the roof with the roof seaming machine support portion 13 disposed beyond the edge of the roof and the side frame rails or members 11 and 12 in straddling relationship to the seam S.

In other words, in use the starting platform 10 would be supported on the roof, as shown in FIG. 1, and a roof seaming machine (not shown) would be supported on the platform 13 for starting the seam S between adjacent roof panels. When the roof seaming machine is on the roof, the gate or bridge 14 may be swung upwardly to enable the roof seaming machine to pass beyond the platform to continue forming a seam between adjacent panels, just as in U.S. Pat. No. 3,669,051.

The roof seaming machine support portion or platform 13 comprises a sheet of material, such as 14 gage steel or the like, formed with an upturned flange 15 on its rearward or outer edge and upturned flanges 16 and 17 on the side edges thereof and a downturned flange 18 on the forward or inner edge thereof. The outer flange 15 provides a stop for preventing inadvertent movement of a roof seaming machine off of the platform 13 and the side flanges 16 and 17 provide a means for attachment of the support portion or platform to the side frame rails 11 and 12. The downturned forward edge flange 18 defines a stop for engaging the edge of the roof to position the starting platform correctly for beginning a seaming operation. A small tab or angle bracket 19 is suitably secured to the upper surface of the platform 13 near the forward edge thereof, as by means of hexhead bolts or the like 20. The tab or flange 19 is normally engaged in the space beneath a seam to accurately position the platform relative to the seam, just as in U.S. Pat. No. 3,669,051.

Figure 4:
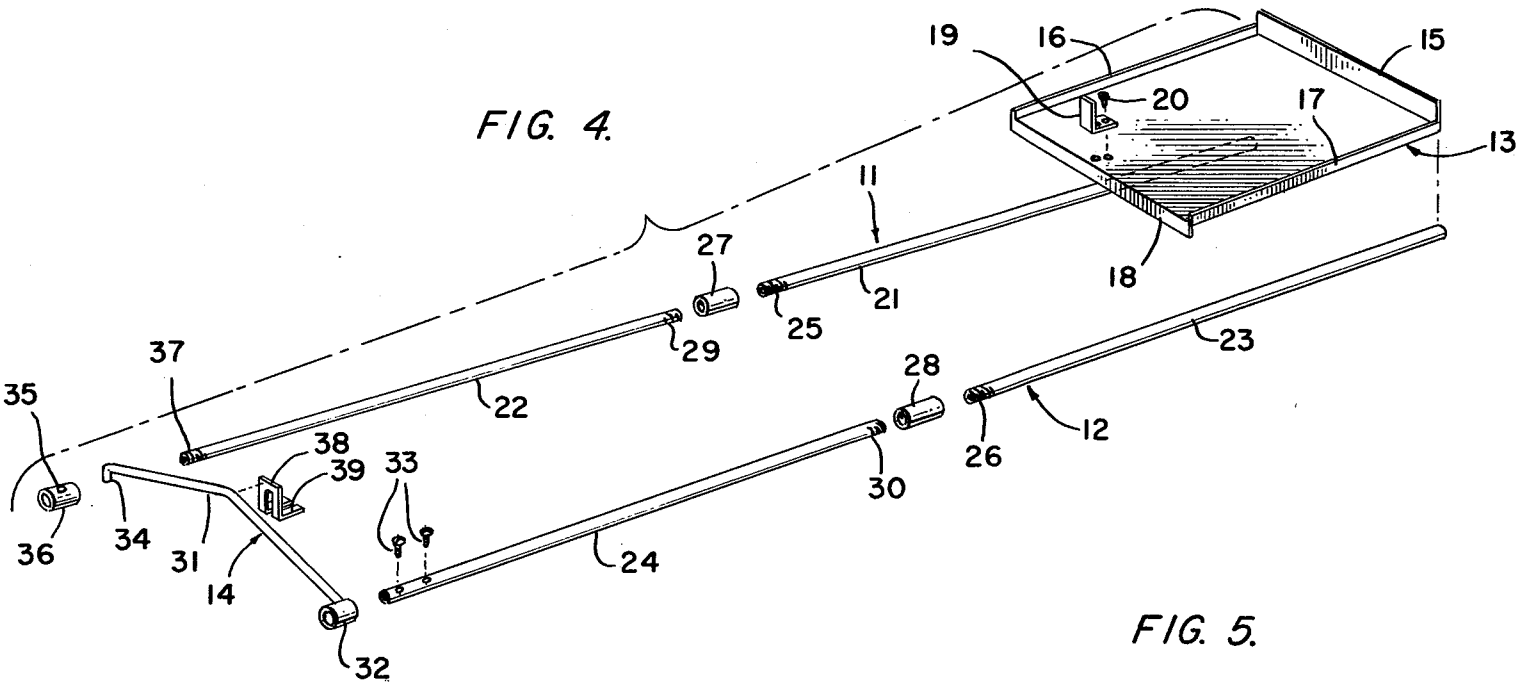
FIG. 4 is an exploded perspective view of the starting platform of the invention.

As seen best in FIG. 4, the side frame rails 11 and 12 are separable substantially intermediate their ends and comprise first and second sections 21, 22 and 23, 24, respectively. In a preferred form of the invention, the sections 21, 22, 23 and 24 comprise ½ inch diameter steel pipe and the rear or outer sections 21 and 23 of the side frame rails 11 and 12 are suitably affixed, as by welding or the like, to the sides of the platform 13. The inner ends of the section 21 and 23 are threaded as at 25 and 26 for cooperation with threaded couplings 27 and 28. The inner sections 22 and 24 are also threaded at 29 and 30 for engagement in the couplings 26 and 27, whereby the sections of the side frame rails may be releasably joined together.

Figure 3:
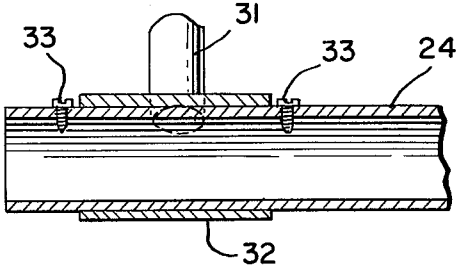
FIG. 3 is a greatly enlarged fragmentary view in section taken along line 3—3 in FIG. 2.
Figure 2:
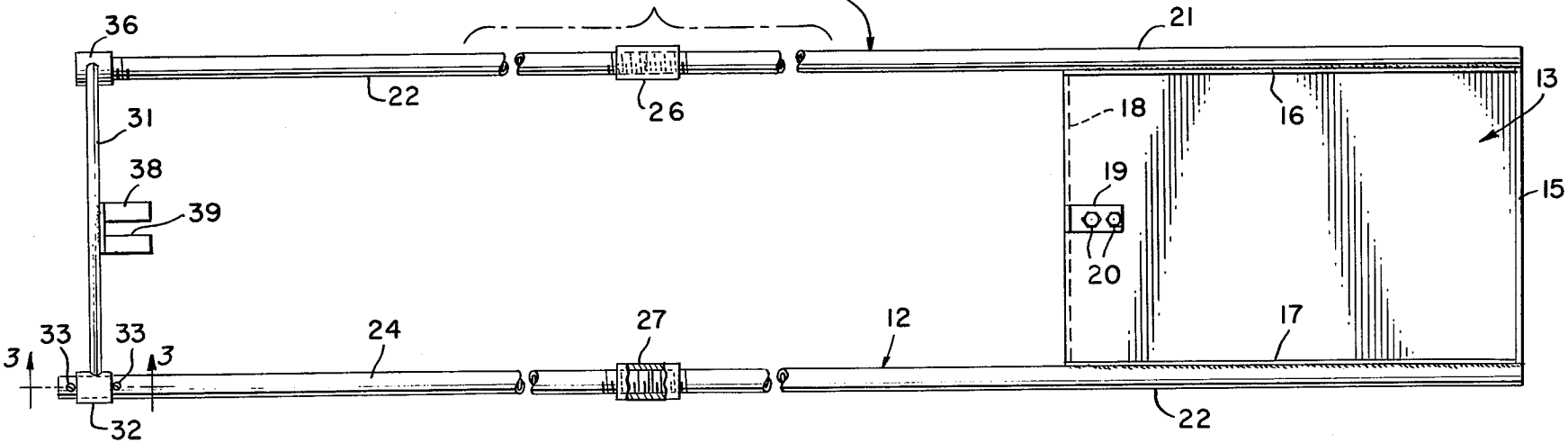
FIG. 2 is a plan view with portions broken away of the starting platform of the invention.

The bridge or gate 14 comprises a length of steel rod 31 bent intermediate its ends, whereby the apex thereof is normally spaced upwardly a distance sufficient to clear a seam between adjacent panels when the bridge or gate is down in its operative position. The rod is welded or otherwise suitably secured at one end to a tubular sleeve 32 which is adapted to be rotatably secured on the adjacent end of section 24 of side frame rail 12 and prevented from moving axially relative thereto by a pair of panhead self-tapping screws 33 extended into the section 24 of side frame rail 12 at opposite ends of the sleeve 32, as seen in FIG. 3, for example. The other end of the rod is bent downwardly at 34, whereby the projection 34 may be received in an opening 35 formed in a second sleeve 36 which is adapted to be threaded on the threaded end 37 of section 22 of the other side frame rail 11. A clamping bracket or angle 38 is suitably secured, as by welding or the like, to the intermediate bent portion of bridge or rod 31 and has a pair of legs defining a slot 39 therebetween in which the upstanding seam S of a pair of adjacent roof panels is received.

Figure 5:
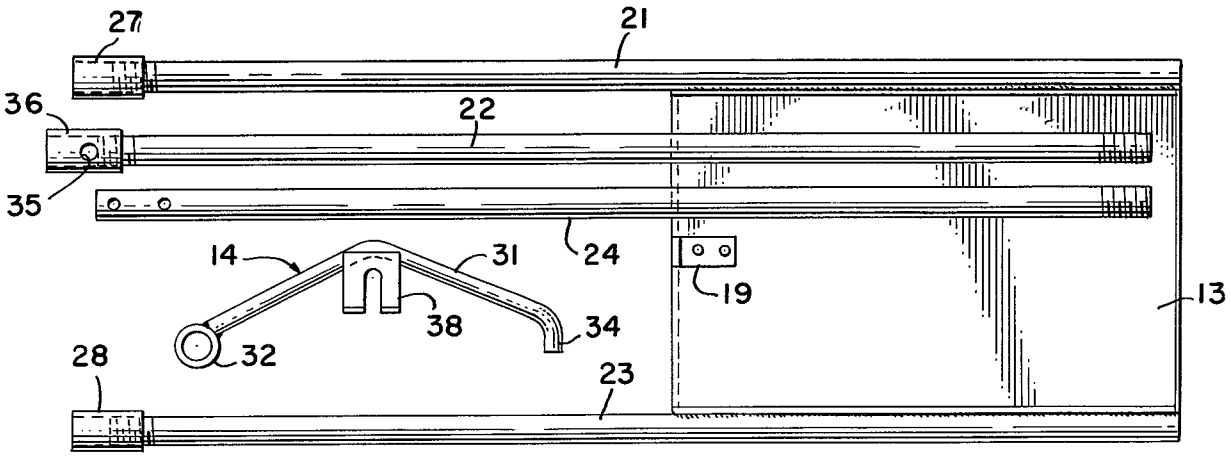
FIG. 5 is a plan view of the starting platform of the invention shown in disassembled or knocked down condition.
Figure 6:
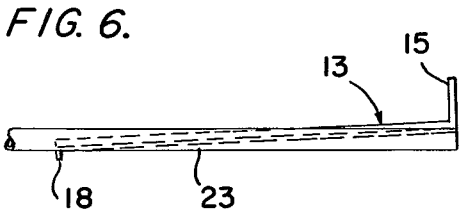
FIG. 6 is a fragmentary view in elevation of a portion of the starting platform showing the relationship between the machine support portion and the side frame members or rails.

Thus, the starting platform of the present invention is relatively simple in construction, and being lightweight is easy to handle. Moreover, and importantly, the starting platform may be disassembled as shown in FIG. 5, whereby it may be shipped by various means of transportation, such as bus or the like, and it may be stored in a minimum amount of space.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

We claim:

1. A kit for a knock-down starting platform for a roof seaming machine, comprising: a machine support platform, a first pair of elongate side frame members connected at one end to the support platform, a second pair of elongate side frame members, a pair of couplings adapted to be mounted on ends of said side frame members for releasably coupling each of said first side frame members to a corresponding one of said second side frame members, a bridge member, connecting means on said bridge member for releasably connecting said bridge member to said second frame members on the other ends of said frame members so that said bridge member is located on the other end of the side frame members and spans the distance therebetween, said bridge member being bent upwardly between the ends thereof to define a clearance space for accommodating therebeneath a seam between adjoined roof panels and said pairs of side frame members being releasably joined together for ease in storage, handling and shipping.

2. A kit for a knock-down starting platform as in claim 1, wherein a clamping member is carried by the bridge intermediate the ends thereof, said clamping member having a slot therein for receiving an upstanding seam formed between adjacent roof panels.

3. A kit for a knock-down starting platform as in claim 2, wherein the connecting means on the bridge member includes a sleeve at one end of said bridge member rotatably received on one of the second side frame members, whereby the bridge member may be rotated about the axis of said one side frame member to move it out of the way of a roof seaming machine.

4. A kit for a knock-down starting platform as in claim 3, wherein the connecting means on the bridge member includes a socket member which is carried by the other one of said second side frame members in a position to receive a downturned end of the bridge member when the bridge member is in its operative position.

5. A kit for a knock-down starting platform as in claim 1, wherein the side frame members comprise lengths of pipe.

6. A kit for a knock-down starting platform as in claim 5, wherein each side frame member comprises a pipe having threaded ends and said couplings include threaded pipe couplings which are engaged on the threaded pipe ends to releasably join the pipes together.

7. A kit for a knock-down starting platform as in claim 6, wherein the bridge comprises a steel rod and said connecting means includes a sleeve member secured to one end of said steel rod and rotatably positioned on the other end of one of the second side frame members, said sleeve member being releasably retained on the one side frame member closely adjacent opposite ends of the sleeve.

* * * * *